US005262827A

United States Patent [19]

Lee

[11] Patent Number: 5,262,827

[45] Date of Patent: Nov. 16, 1993

[54] LIGHT EMITTING DIODE PRINTER

[75] Inventor: Dong-Ho Lee, Seongnam, Rep. of Korea

[73] Assignee: SamAung Electronics Co., Ltd., Kyunki, Rep. of Korea

[21] Appl. No.: 870,914

[22] Filed: Apr. 20, 1992

[30] Foreign Application Priority Data

Apr. 22, 1991 [KR] Rep. of Korea ..... 1991-6427

[51] Int. Cl.[5] ..... G03G 15/04

[52] U.S. Cl. ..... 355/229; 355/228; 355/67

[58] Field of Search ..... 355/229, 228, 67, 210, 355/211, 200, 202, 296, 300; 346/160.1, 167 R

[56] References Cited

U.S. PATENT DOCUMENTS 4,634,264 1/1987 Takahashi ..... 355/200
5,089,846 2/1992 Tabuchi ..... 355/200
5,095,335 3/1992 Watanabe et al. ..... 355/210

*Primary Examiner*—A. T. Grimley
*Assistant Examiner*—Matthew S. Smith
*Attorney, Agent, or Firm*—Robert E. Bushnell

[57] ABSTRACT

An LED printer includes a lower body frame, an upper body frame being detachably mounted on the lower body frame, an LED frame with a lever mounted on the upper body frame for supporting an LED head array, a spring connected between a right end portion of the LED frame and the upper body frame, and a process unit with an upper leading end for mounting a photo-sensitive drum. The LED head array is mounted beneath the right end portion of the LED frame, and the upper leading end pushes the lever when the process unit is installed inside the upper body frame so that a distance between the photo-sensitive drum and the LED head array is properly maintained. The LED frame is pivoted on a hinge to an inoperative position by a recovering force of a spring connected between the upper body frame and the LED frame.

9 Claims, 5 Drawing Sheets

LIGHT EMITTING DIODE PRINTER

BACKGROUND OF THE INVENTION

The present invention relates to a light emitting diode (LED) printer, and more particularly to a mechanism for changing the process unit thereof.

In a conventional LED printer as shown in FIG. 1, a control circuit causes an LED head array 4 to expose a photo-sensitive drum 11 to light, in response to printing input data from a computer (not shown). The surface of the photo-sensitive drum 11 is charged with a constant voltage by an electric charger 14, and the portions of the photo-sensitive drum 11 exposed to light by the LED head array 4 come to have reduced voltages, so that an electrostatic latent image is formed on the photo-sensitive drum 11 due to the voltage differences between the initially charged voltage of the portions not exposed to the light and the reduced voltages of the portions exposed to the light. Thereafter, as the photo-sensitive drum 11 is rotated, the toner of a developer 15 is attracted to the surface of the photo-sensitive drum 11 so as to develop the latent image.

Meanwhile, the printing paper is supplied from a paper supplying device 16, aligned by a pair of register rolls 17, and conveyed to a transferring device 18 where the toner developing the latent image on the photo-sensitive drum 11 is transferred to the printing paper. The printing paper adhering to the photosensitive drum 11 by the electrostatic force is separated from the photo-sensitive drum 11 by a separator 19, and conveyed by a conveyor belt 20 to a fixing device 21, where the printing paper is heated and pressed between a heat roll 22 and pressure roll 23 to fix the toner and conveyed to a discharging tray. The residual toner on the photo-sensitive drum 11 is removed by a cleaning device 24, transmitted through an auger 25 to a vessel for collecting the used toner, and the latent image is canceled by the light supplied from a latent image removing lamp 26.

If a printing paper is jammed in the printer, the upper body frame 2 is upwardly pivoted on a hinge 27 detached from the lower body frame 1 to remove the jammed printing paper.

The lower body frame 1 has the paper supplying device 16, fixing device 21, transferring device 18, etc. The upper body frame 2 has a receptacle for receiving the process unit 6 with the cleaning device 24, photo-sensitive drum 11, electric charger 14, and developer 15, and on the upper side thereof is mounted an LED frame 3 for supporting the LED head array 4. The process unit 6 having the cleaning device 24, photo-sensitive drum 11, electric charger 14, and developer 15 is disclosed in U.S. Pat. No. 3,985,436. The LED frame 3 is manually opened and closed pivoting on a hinge 8. Hence, in order to change the process unit 6 first the upper body frame 2 is opened from the lower body frame 1, and then the lever 28 on the frame 3 is pressed so as to release a hook 29 from the holding pin 30 attached to the upper body frame 2. Thus the LED frame 3 is opened upwardly so as to remove the process unit 6 from a unit guide 9.

On the contrary, if the process unit 6 is mounted in the unit guide 9 and the frame 3 including the LED head array 4 is pivoted downwardly on the hinge 8, the hook 29 of the lever 28 is fixedly held by the holding pin 30, so that the LED head array 4 may be positioned facing the photo-sensitive drum 11 through the opening 10 formed in the upper part of the unit guide 9 with a proper interval therebetween.

As stated above such a conventional LED printer is complicated and requires manual disassembling and assembling of related component parts to change the process unit 6.

SUMMARY OF THE INVENTION

It is an object of the present invention to provide a mechanism for easily changing a process unit in an LED printer.

According to an aspect of the current invention, an LED printer has a lower body frame, an upper body frame being detachably mounted on the lower body frame, an LED frame with a lever mounted on the upper body frame for supporting an LED head array, a spring connected between the right end portion of the LED frame and the upper body frame, and a process unit with an upper leading end for mounting a photo-sensitive drum, wherein the LED head array is mounted beneath the right end portion of the LED frame, and the upper leading end pushes the lever when the process unit is installed inside the upper body frame so that the distance between the photo-sensitive drum and LED head array is properly maintained. The LED frame is pivoted on a hinge to the inoperative position by the recovering force of a spring connected between the upper body frame and LED frame.

BRIEF DESCRIPTION OF THE ATTACHED DRAWINGS

For a better understanding of the invention and to show how the same may be carried into effect, reference will now be made, by way of example, to the accompanying diagrammatic drawings, in which.

DETAILED DESCRIPTION OF THE PREFERRED EMBODIMENTS

Figure 1:
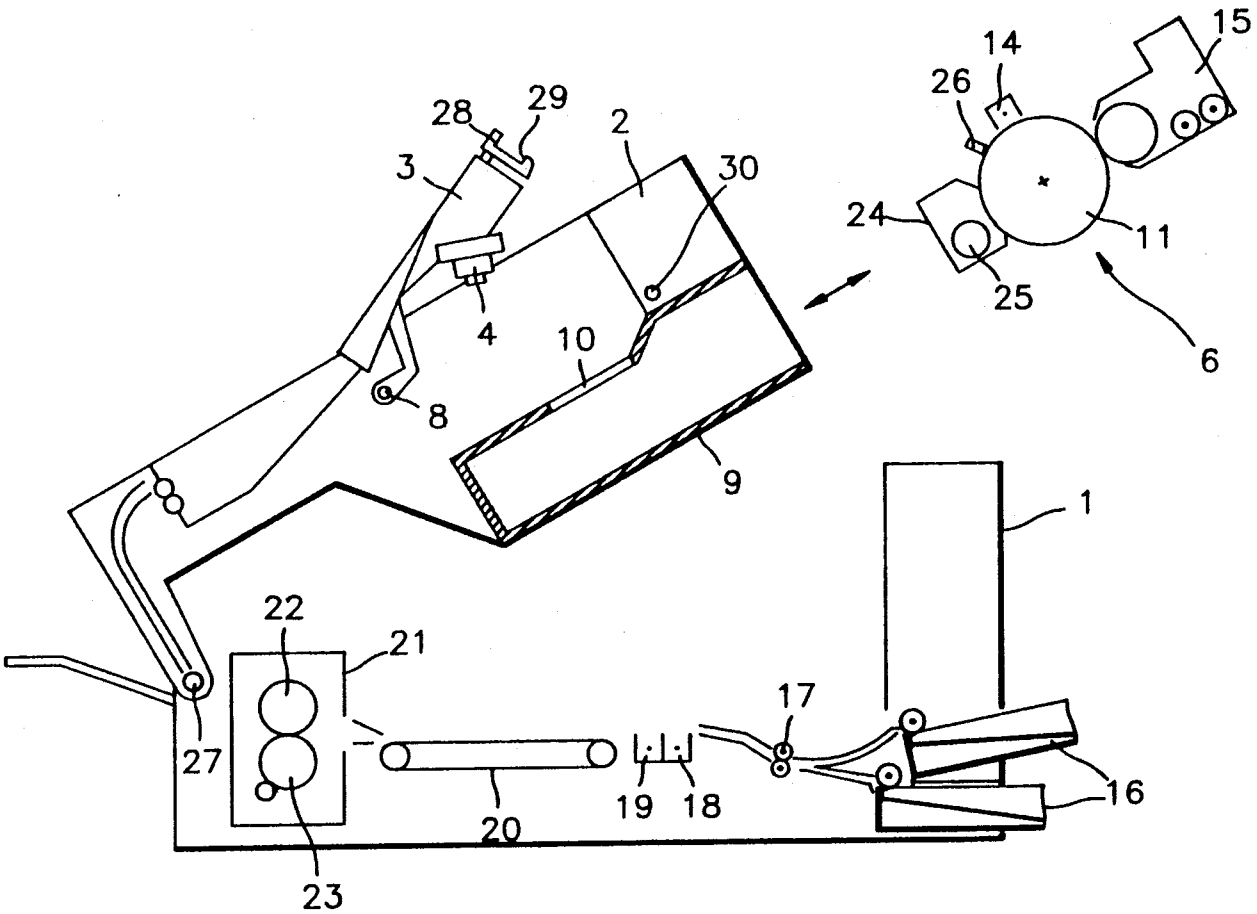
(PRIOR ART) FIG. 1
FIG. 1 is a diagram for illustrating the structure of a conventional LED printer.
Figure 2:
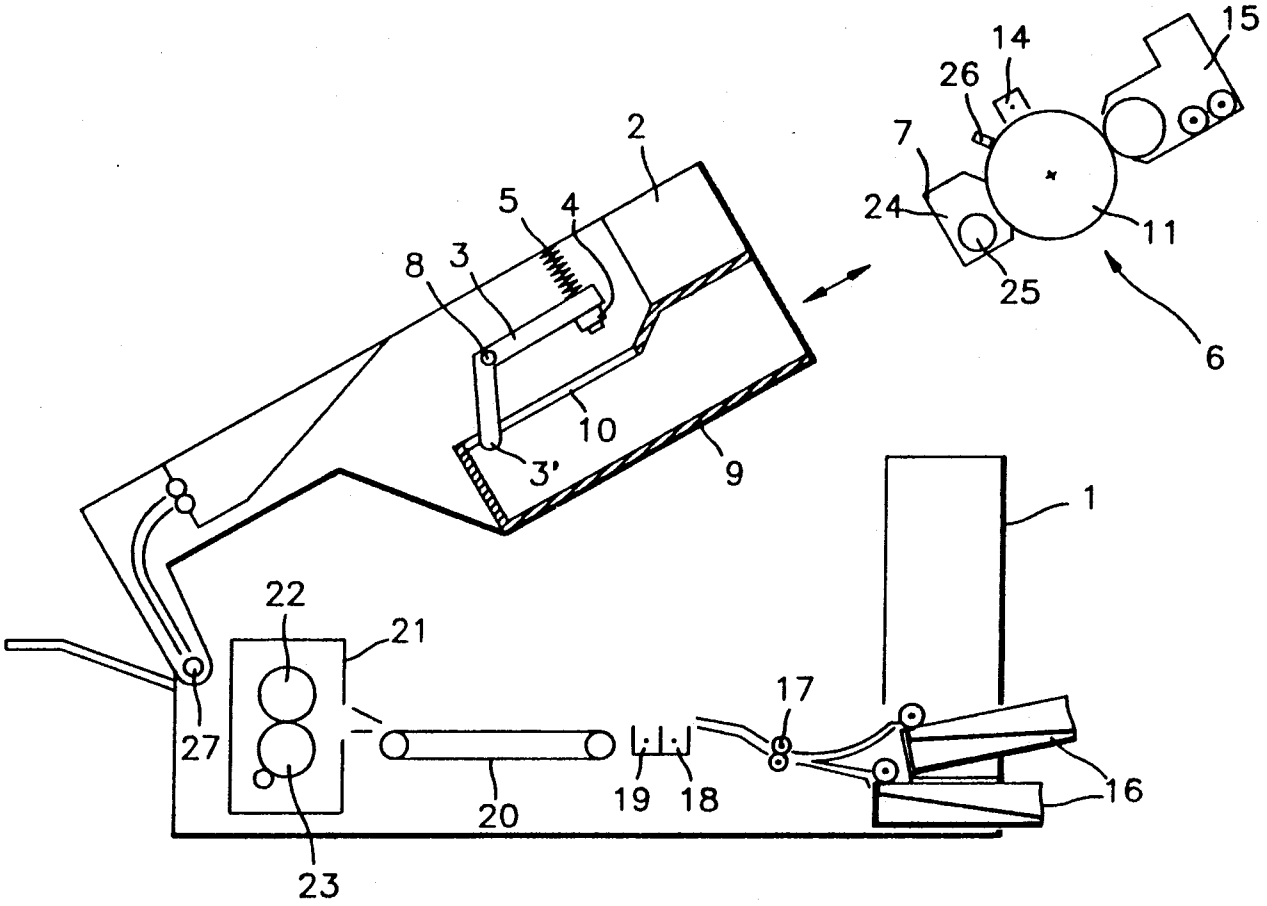
FIG. 2 is a diagram for illustrating the structure of an LED printer according to one embodiment of the present invention.
Figure 3:
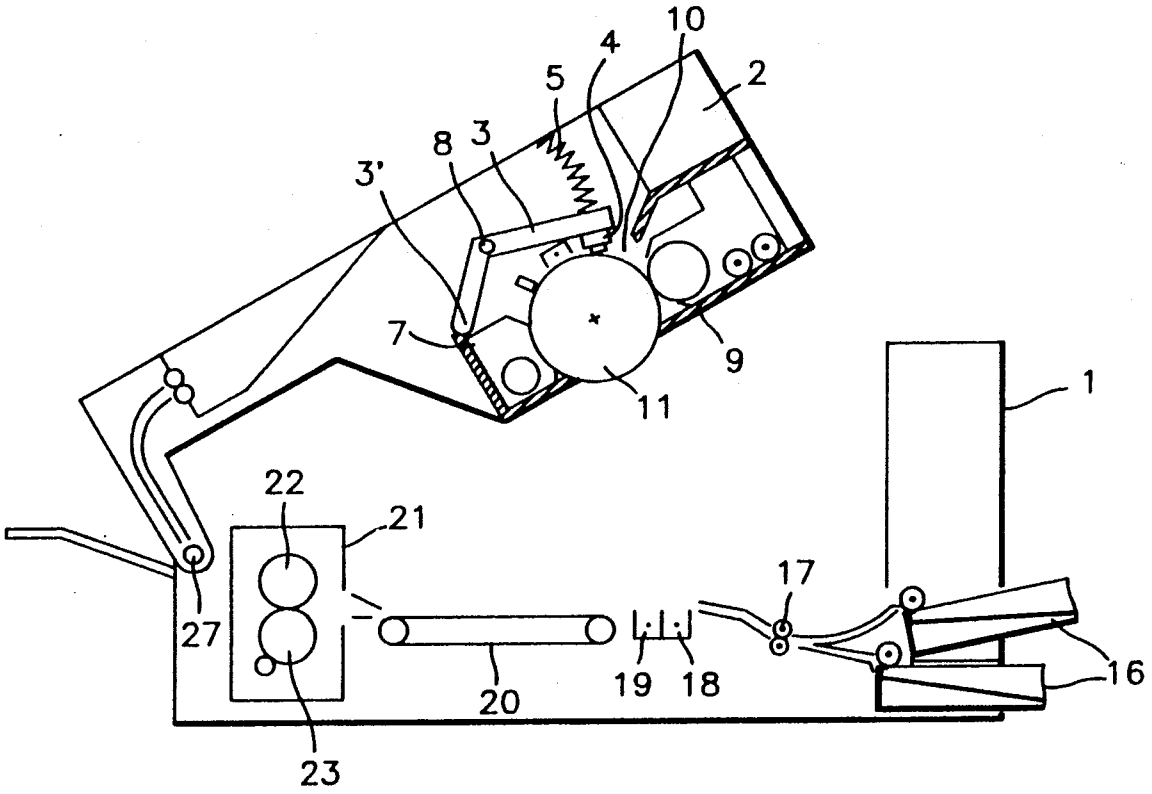
FIG. 3 is a view for illustrating the operating position of the process unit of FIG. 2.

Referring to FIGS. 2 and 3, an upper body frame 2 is detachably mounted on a lower body frame 1. A bent LED frame 3 with a lever 3' is pivotally mounted on a hinge 8 in the upper body frame 2 to support an LED head array 4 beneath the right end portion thereof. A spring 5 is connected between the upper body frame 2 and the right end portion of the LED frame 3. A process unit 6 includes an upper leading end 7 together with a photosensitive drum 11. When the process unit 6 is installed inside a unit guide 9 with an upper opening 10, the upper leading end 7 pushes the lever 3' so that the distance between the photosensitive drum 11 and LED head array 4 is properly maintained, as shown in FIG. 3.

When the process unit 6 is removed from the inside of the unit guide 9, as shown FIG. 2, the right end portion of the LED frame 3 supporting the LED head array 4 moves upwardly out of the upper opening 10 of the unit guide 9 by the recovering force of the spring 5, thus sufficiently separating the LED head array 4 from the photo-sensitive drum 11. Namely, the LED frame 3 is pivoted on the hinge 8 to the inoperative position by the recovering force of the spring 5 connected between the upper body frame 2 and LED frame 3.

On the contrary, if the process unit 6 is inserted into the unit guide 9, the upper leading end 7 pushes upwardly the lever 3' of the LED frame 3, so that the LED frame 3 is pivoted on the hinge 8 to downwardly move right end portion thereof supporting the LED head array 4 into the upper opening 10 of the unit guide 9. Hence, the distance between the photo-sensitive drum 11 and LED head array 4 is properly maintained, as shown in FIG. 3. Thus, the changing of the process unit may be easily achieved.

Figure 4:
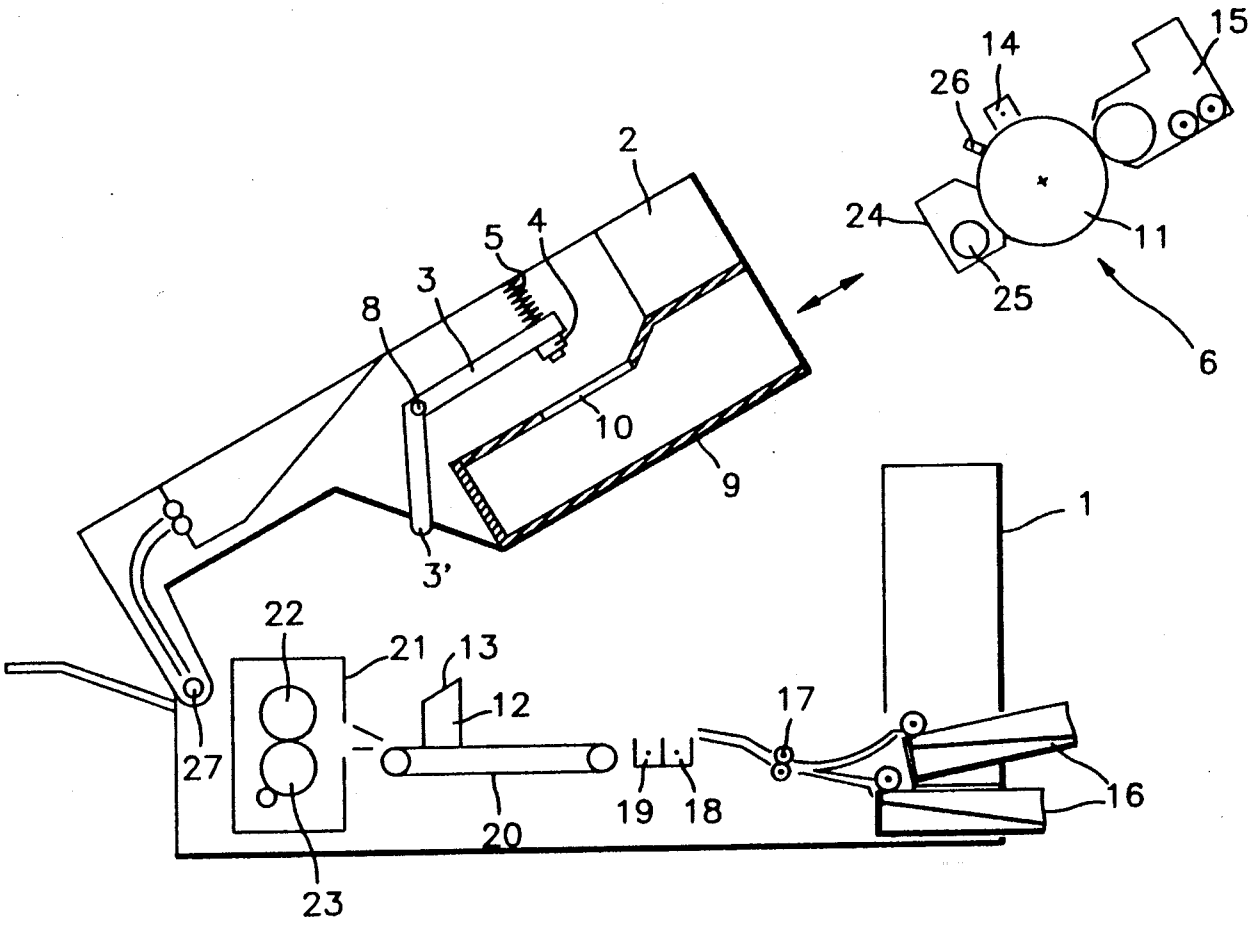
FIG. 4 is a diagram for illustrating the structure of an LED printer according to another embodiment of the present invention.
Figure 5:
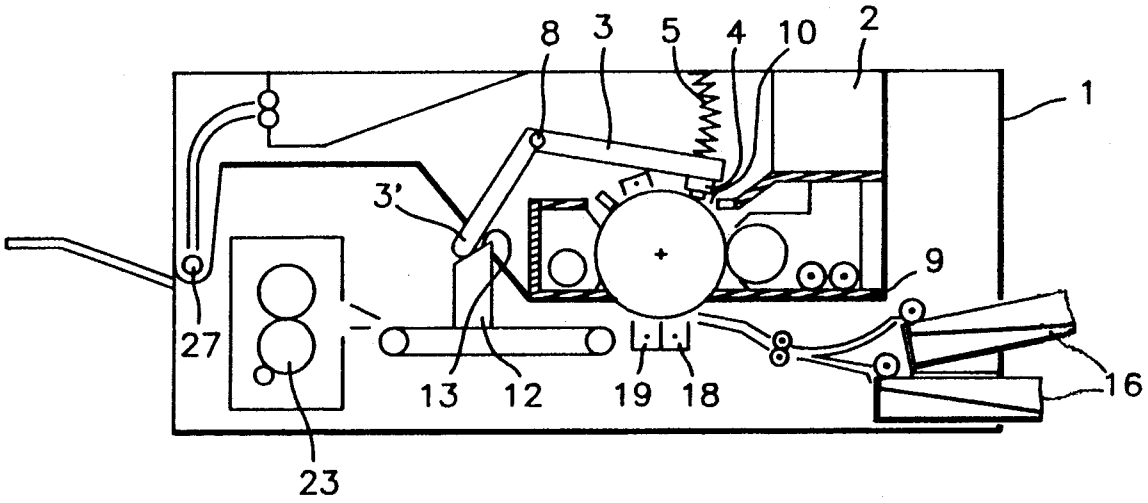
FIG. 5 is a view for illustrating the operating position of the process unit of FIG. 4.

In another embodiment of the present invention as shown in FIGS. 4 and 5, a pivot 12 with an upper left sloped surface 13 is provided in the lower body frame 1 instead of the upper leading end 7 of the process unit 6 for pushing the lever 3' as shown in the previous embodiment. Namely, the lever 3' is to be guided along the upper left sloped surface 13 of the pivot 12. When the upper body frame 2 is opened to change the process unit 6 or to remove a jammed printing paper, as shown FIG. 4, the lever 3' of the LED frame 3 is separated from the pivot 12 so as to pivot the LED frame 3 on the hinge 8 by the recovering force of the spring 5, thus moving upwardly the LED head array 4 out of the upper opening 10 of the unit guide 9.

On the contrary, if the upper body frame 2 is closed with the process unit 6 inserted in the unit guide 9 to engage the lower body frame 1, the lever 3' is guided by the upper left sloped surface 13 of the pivot 12 pushed upwardly, so that the LED frame 3 is pivoted on the hinge 8 to downwardly move the LED head array 4 into the upper opening 10 of the unit guide 9 so as to properly maintain the distance between the photo-sensitive drum 11 and the LED head array 4. In this case, the spring 5 is stretched under the tension. The spring 5 disclosed in FIGS. 2 to 5 as a tension spring may be substituted by a torsion spring or a compression spring.

Thus, if the upper body frame is separated from the lower body frame, the LED head array is automatically released from the unit guide by the recovering force of the spring attached to the LED frame, thereby facilitating the change of the process unit.

A mechanism according to the current invention may be used in a facsimile machine when a transmitter part of the facsimile machine is installed on the upper body frame 2 and the other device is used as a receiver printing part of the facsimile machine.

While the invention has been particularly shown and described with reference to a preferred embodiment, it will be understood by those skilled in the art that modifications in detail may be made without departing from the spirit and scope of the invention.

What is claimed is:

1. A light emitting diode printer comprising:

a lower body frame;

an upper body frame being detachably mounted on said lower body frame;

a light emitting diode frame coupled to said upper body frame, having first and second portions of a lever fixedly connected at an angle, said second portion supporting a light emitting diode head array for applying light to a photo-sensitive drum, said second portion being connected to said upper body frame by a spring; and a process unit comprising an upper leading end and the photosensitive drum, said process unit being inserted and removed from said upper body frame in a direction perpendicular to an axis of the photo-sensitive drum and perpendicular to a longitudinal axis of the light emitting diode head array;

said upper leading end pushing said first portion of said lever upwardly pivoting on a hinge so that the light emitting diode head array is moved to a predetermined position from the photo-sensitive drum when said process unit is inserted into said upper body frame, and said first portion of said lever being restored to an inoperative position so that the light emitting diode head array is moved away from the photo-sensitive drum when said process unit is removed from said upper frame.

2. The light emitting diode printer as claimed in claim 1, wherein said spring is one of a tension spring, a torsion spring and a compression spring.

3. A light emitting diode printer comprising:

a lower body frame an upper body frame detachably mounted on said lower body frame;

an angled frame comprising a contact end, a light emitting diode end connected to the upper body frame by a spring and supporting a light emitting diode array for applying light to a photo-sensitive drum, and a hinge between the contact end and the light emitting diode end used to pivot movement of the contact end and the light emitting diode end; and a process unit, movable in a direction perpendicular to an axis of the photo-sensitive drum and perpendicular to a longitudinal axis of the light emitting diode array, comprising the photo-sensitive drum and an upper leading end, said upper leading end moving said contact end upward and simultaneously moving said light emitting diode end downward to a predetermined operable distance from said photo-sensitive drum when said process unit is inserted into a unit guide, said spring moving said light emitting diode end upward and away from said photo-sensitive drum and simultaneously moving said contact end downward when said process unit is removed from said unit guide.

4. The light emitting diode printer of claim 3, wherein said spring is one of a tension spring, a torsion spring and a compression spring.

5. A light emitting diode printer comprising:

a lower body frame;

an upper body frame detachably mounted on said lower body frame;

a process unit having a photo-sensitive drum and removably installable in said upper body frame to position said drum in an operative position;

a pivot-causing member provided in said lower body frame and having an upper sloped surface;

a unitary support frame member pivotally mounted on said upper body frame by a hinge and having a contact portion and support portion supporting a light emitting diode head array for applying light to said photo-sensitive drum, said contact portion and said support portion being oriented at an angle less than 180° with respect to each other about said hinge, wherein when said upper body frame is closed to engage said lower body frame, said contact portion makes contact with said sloped surface and is moved by said pivot-causing member, causing said frame member to rotate about said hinge to position the light emitting diode head array a predetermined distance from said photo-sensitive drum; and a spring coupling said support portion of the support frame member to said upper body frame, wherein when said upper body frame is separated from said lower body frame, the support portion of said support frame member is rotated by said spring to move the light emitting diode head array away from the photo-sensitive drum.

6. The light emitting diode printer as claimed in claim 5, wherein said spring is one of a tension spring, a torsion spring and a compression spring.

7. A light emitting diode printer comprising:

a lower body frame;

an upper body frame detachably mounted on said lower body frame;

a removable process unit having a photo-sensitive drum and disposed in said upper body frame;

an angled unitary frame having a contact end and a support end supporting a light emitting diode array for applying light to said photo-sensitive drum;

a hinge mounting said angled frame on said upper body frame for pivotal movement about said hinge of said contact end and said support end, said contact end and said support end being oriented at an angle less than 180° with respect to each other about said hinge;

a pivot-causing element in said lower body frame having an inclined upper surface, said pivot-causing element moving said angled frame contact end upward and simultaneously rotating said support end downward to a predetermined operable distance from said photo-sensitive drum when said upper body frame is closed onto said lower body frame, the operable distance being determined by the orientation angle between said contact end and said support end about said hinge; and a spring connected between said upper body frame and said angled frame support end for moving said support end upward and away from said photo-sensitive drum and simultaneously moving said contact end downward when said upper body frame is opened from said lower body frame.

8. The light emitting diode printer of claim 7, wherein said spring is one of a tension spring, a torsion spring and a compression spring.

9. The light emitting diode printer of claim 7, wherein said removable process unit is removable from said upper body frame when said upper body frame is opened from said lower body frame.

* * * * *